United States Patent [19]

Kish

[11] 4,416,425

[45] Nov. 22, 1983

[54] PAPER ROLL DISPENSER

[76] Inventor: Paul Kish, 15102 Kenoak Dr., Baldwin Park, Calif. 91706

[21] Appl. No.: 370,086

[22] Filed: Apr. 20, 1982

[51] Int. Cl.[3] ..... B65H 19/00

[52] U.S. Cl. ..... 242/55.2; 211/171

[58] Field of Search ..... 242/55.2, 55.3, 55.53, 242/55.54; 225/46, 47; 211/170, 171, 99, 100

[56] References Cited

U.S. PATENT DOCUMENTS

| | | | |
|---|---|---|---|
| 1,047,535 | 12/1912 | Kearney | 242/55.2 |
| 1,889,024 | 11/1932 | Marsh | 242/55.2 |
| 2,517,809 | 8/1950 | Tarzian | 242/55.2 |
| 3,022,957 | 2/1962 | Blunt et al. | 242/55.2 |
| 3,823,889 | 7/1974 | Johnson et al. | 242/55.2 |
| 4,102,510 | 7/1978 | Anderson | 242/55.2 |
| 4,222,532 | 9/1980 | DeLuca | 242/55.2 |

*Primary Examiner*—Leonard D. Christian
*Attorney, Agent, or Firm*—Fulwider, Patton, Rieber, Lee & Utecht

[57] ABSTRACT

A paper roll dispenser which permits easy roll replacement while presenting a decorative appearance is provided for dispensing a roll of paper such as toilet tissue, paper towels or the like. The roll dispenser comprises a bracket having two generally parallel elongated support arms extending therefrom in a direction generally perpendicular to a front face of the bracket such that each support arm is free to rotate about its arm axis. When the paper roll dispenser is in an operative position, a spindle having one end attached to one of the support arms rotatably supports the roll of paper between the support arms. The roll is replaced by rotating the one support arm about its arm axis and thereby moving the spindle into a position wherein it projects generally away from the other support arm whereupon a roll supported by the spindle can be replaced. A stop tab protruding from the front face of the bracket engages an inboard face of the one support arm to limit rotation of that support arm when the spindle is projecting away from the other support arm for roll replacement. Fasteners, such as screws, used to attach the bracket to a support surface are concealed behind the support arms when the support arms are rotated to their operative positions.

11 Claims, 6 Drawing Figures

PAPER ROLL DISPENSER

BACKGROUND OF THE INVENTION

This invention relates generally to paper roll dispensers, and more particularly, to paper roll dispensers which facilitate replacement of rolls.

The prior art is replete with roll dispensers for dispensing rolls of paper such as toilet tissue, paper towels or the like. Roll dispensers of this general type commonly comprise two support arms with a spindle spring mounted between them. Such spindles typically comprise a pair of hollow tubular members which are partially telescoped together and a spring which produces a spring tension urging the tubular members apart whenever they are further telescoped together. The tubular members are pushed more closely together to fit the spindle between the support arms, and once fitted, the spring maintains the spindle between the support arms.

While earlier roll dispensers of this type have generally been effective, there have been shortcomings with their use. Specifically, problems exist with replacement of expended rolls. Placing a new roll on the spindle generally involves manipulating at least three elements: the new roll, the core from the expended roll and the spindle. This makes the operation awkward to perform with two hands. The problem of roll replacement is especially acute for the elderly and for handicapped persons, such as those suffering from arthritis, who have lost dexterity in their hands. For these people, the process of pressing together the tubular spindle-forming members and aligning the spindle with a fresh roll mounted thereon between the support arms can be an extremely difficult task.

Accordingly, there has existed a need for an improved paper roll dispenser which simplifies the replacement of expended rolls with fresh ones. The present invention meets this need.

SUMMARY OF THE INVENTION

The present invention resides in a paper roll dispenser which simplifies the removal and replacement of paper rolls while presenting a decorative appearance. Moreover, the paper roll dispenser of the instant invention also performs the traditional functions of rotatably supporting a paper roll thereby permitting the roll to be selectively unwound.

More particularly, in a presently preferred embodiment of the invention, the paper roll dispenser includes a bracket adapted for attachment to a support surface, such as a wall for example, by fasteners, such as screws, nails or the like, projecting through a front face of the bracket. First and second elongated support arms project from the bracket in a spaced and generally parallel relationship and in a direction generally perpendicular to the front face. The support arms are rotatably secured to the bracket for rotation about their respective arm axes. The fasteners and the support arms are positioned relative to the bracket and to each other such that rotation of the support arms permits the fasteners to be selectively exposed to view for fastening to the support surface and thereafter to be concealed from view behind the support arms such that the fasteners do not interfere with the decorative appearance of the paper roll dispenser.

A spindle has a first end secured near a distal end of a first support arm, and it has a length sufficient to span the distance between the two support arms. In an operative position with the spindle spanning the two support arms, a second support arm blocks removal of an paper roll which can be rotatably supported by the spindle. For convenient roll replacement, the first support arm is rotated about its arm axis to move the spindle to an elevated position clear of the second support arm.

A stop tab protruding from the front face of the bracket limits rotation of the first support arm when the spindle is in either its operative or its elevated positions. When the spindle spans the support arms in its operative position, the stop tab is substantially hidden from view within a recess formed at the proximal end of the first support arm wherein the stop tab cooperates with a shoulder forming one wall of the recess and thereby limits rotation of the first support arm and maintains the spindle in its operative position. When the spindle is in its elevated position, its spindle axis projects in a direction generally perpendicular to its orientation in the operative position, and the stop tab cooperates with an inboard face near a proximal end of the first support arm to limit rotation of the first support arm and thereby maintain the spindle in its elevated position for the duration of a roll changeover procedure.

In one preferred form, the stop tab advantageously comprises the head of a screw used to secure the bracket to the support surface. If desired, the screw head can be formed with an enlarged thickness for appropriate engagement with either the shoulder or the inboard face defined by the first support arm.

Other advantages and features of the present invention will be apparent from the following detailed description, taken in conjunction with the accompanying drawings, which illustrate, by way of example, the principles of the invention.

BRIEF DESCRIPTION OF THE DRAWINGS

The following drawings illustrate the invention. In such drawings.

DETAILED DESCRIPTION OF THE PREFERRED EMBODIMENT

Figure 1:
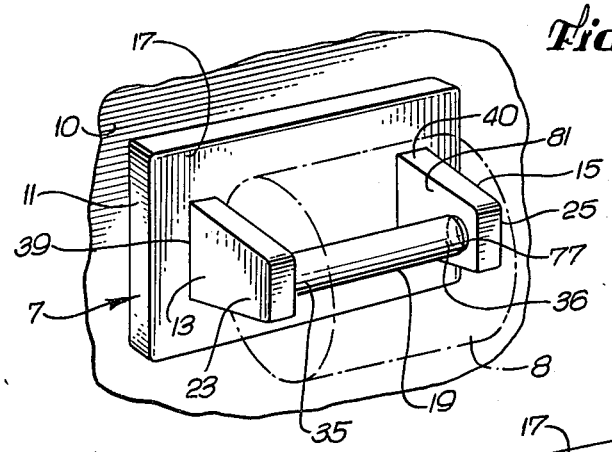
FIG. 1 is a perspective view illustrating the paper roll dispenser embodying the novel features of the invention with a roll of paper material being depicted by broken lines.

As shown in the exemplary drawings, the present invention is embodied in a novel paper roll dispenser, designated generally by reference numeral 7, for rotatably supporting a paper roll 8. The paper roll dispenser 7 includes a bracket 11 having first and second support arms 13 and 15 extending therefrom in a spaced and generally parallel relationship and in a direction generally perpendicular to a front face 17 of the bracket 11. A spindle 19 spans the free ends 23 and 25 of the first and second support arms 13 and 15 and is adapted to receive a paper roll 8 including a roll of paper material such as toilet paper, paper towels or the like which, as illustrated, typically has a cylindrical central core 27 through which the spindle 19 projects. The paper roll 8 is unwound by rotating it about a longitudinal axis of the spindle 19.

The paper roll dispenser 7 of the present invention advantageously permits easy replacement of exhausted or extended paper rolls 8 by simplifying the roll replcement procedure. The invention is particularly useful to handicapped persons who find it difficult to perform the many awkward steps which are generally necessary to replace a paper roll 8. In addition, a preferred form of the invention provides these advantages without detracting from the decorative appearance of the paper roll dispenser 7.

More particularly, as illustrated by a presently preferred embodiment of the invention in FIGS. 1–6, the paper roll dispenser 7 includes a bracket 11 having a front face 17 which is exposed to view and a back face 18 which is placed against a support surface 10 such as a wall, cabinet, or the like. The bracket is attached to the support surface by fasteners 41, 43, 45 and 47, such as screws, which project through holes 49, 51, 53 and 55 in the bracket 11 and fasten into the support surface.

Figure 4:
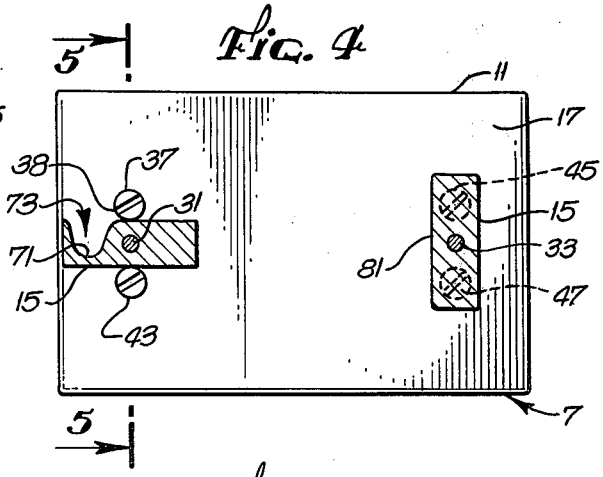
FIG. 4 is a vertical section view generally on line 4—4 of FIG. 3.
Figure 5:
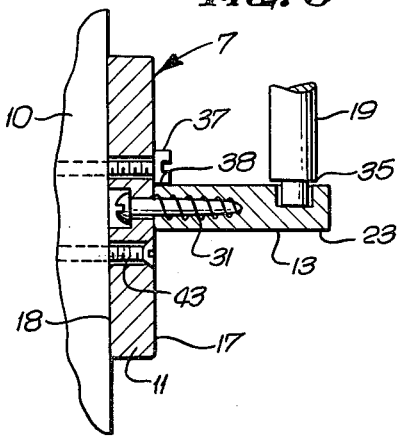
FIG. 5 is a vertical section view generally on line 5—5 of FIG. 4.
Figure 6:
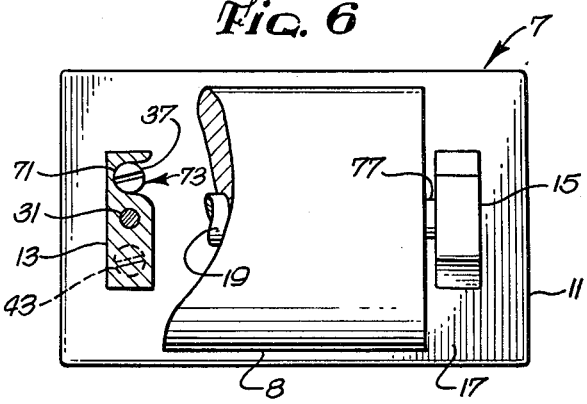
FIG. 6 is a front elevation view of the paper roll dispenser, with portions broken away to illustrate construction details thereof.

As best shown in FIGS. 4–6, the first and second elongated support arms 13 and 15 extend from the front face 17 of the bracket 11 in a spaced and generally parallel relationship and in a direction generally perpendicular to the front face 17 of the bracket 11. The support arms 13 and 15 are rotatably secured to the bracket 11 by fasteners 31 and 33, such as screws, inserted through the back face 18 of the bracket and into proximal ends 39 and 40 of the support arms 13 and 15 such that each support arm 13 and 15 can be rotated about its arm axis, for purposes which will be described herein in more detail.

The spindle 19 has a first end 35 attached in any suitable manner to the free end 23 of the first support arm 13. The spindle 19 is adapted for insertion through the cylindrical central core 27 of a paper roll 8. When the roll dispenser 7 is in an operative configuration as viewed in FIGS. 1 and 6, the spindle 19 spans the two support arms 13 and 15 and rotatably supports the paper roll 8 between the support arms 13 and 15 such that the second support arm 15 blocks the paper roll 8 from sliding off the spindle 19. The paper roll 8 is unwound in a normal manner during use by rotating it about a longitudinal axis of the spindle 19.

The roll dispenser 7 is moved to an alternative position for easy roll replacement by rotating the first support arm 13 about its arm axis such that the spindle 19 swings clear of the second support arm 15 to an elevated position wherein the longitudinal axis of the spindle 19 extends in a direction generally perpendicular to its previous orientation spanning the two support arms 13 and 15. When the spindle 19 is disposed in this elevated position, the paper roll 8 is easily replaced by a procedure readily accomplished with one hand including removing the current roll from the spindle 19 and then placing a new roll onto the spindle 19. After replacement, the spindle 19 is pivoted to its previous position spanning the support arms 13 and 15.

A stop tab 37, which can for example be an enlarged head of the screw 41 used to secure the bracket 11 to the support surface, protrudes from the front face 17 of the bracket 11 adjacent to the first support arm 13 to limit rotation of that support arm about its arm axis. When the spindle 19 spans the two support arms 13 and 15, the stop tab 37 cooperates with a shoulder 71 forming one wall of a recess 73 formed generally at the proximal end 39 of the first support arm 13. The stop tab 37 is advantageously concealed from view within the recess 73 wherein the cooperation between the stop tab 37 and the shoulder 71 limits the rotation of the first support arm 13 and thereby maintains the spindle 19 and the supported paper roll 8 between the two support arms 13 and 15.

When the spindle 19 is moved the elevated position, the stop tab 37 cooperates with an inboard face 38 at the proximal end 39 of the first support arm 13 to limit rotation of that support arm about its arm axis. The cooperation between the stop tab 37 and the inboard face 38 of the first support arm 13 thereby advantageously maintains the spindle 19 in an upright elevated position wherein roll replacement can be accomplished with ease and simplicity without fear of over-rotation of the spindle 19 and without any requirement to hold the spindle 19 manually during roll replacement.

In a presently preferred form of the invention best shown in FIGS. 3 and 4–6, the fasteners 41, 43, 45 and 47 projecting through the holes 49, 51, 53 and 55 in the front face 17 of the bracket 11 are positioned adjacent to the support arms 13 and 15 such that they can be exposed to view or concealed from view by rotation of the support arms 13 and 15 about their respective arm axes. The support arms 13 and 15 have a cross-sectional shape such that rotation of the support arms 13 and 15 permits the fasteners 41, 43, 45 and 47 to be advantageously exposed to view for insertion into the bracket 11 at the time the bracket is fastened to the support surface 10 and thereafter concealed from view behind the proximal ends 39 and 40 of the support arms 13 and 15 so that they do not detract from the decorative appearance of the paper roll dispenser 7. With the exception of the hole 49 for receiving the fastener 41 having the enlarged head serving as the stop tab 37, the holes 51, 53 and 55 through which the fasteners 43, 45 and 47 project are surrounded by countersinks 59, 61 and 63 such that the fasteners 43, 45 and 47 fit flush with respect to the front face 17 of the bracket 11 to facilitate concealment behind the support arms 13 and 15.

Figure 3:
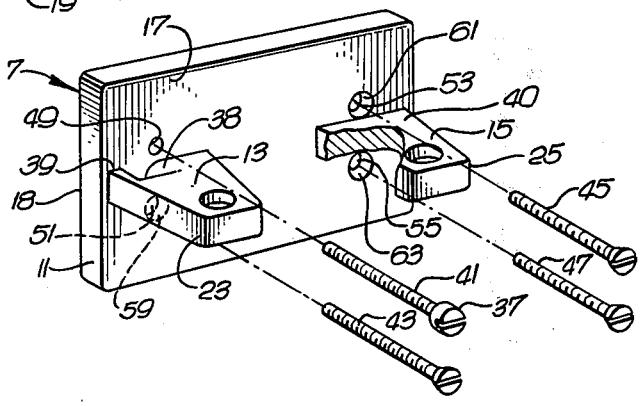
FIG. 3 is an exploded perspective view partially broken away illustrating assembly details of the paper roll dispenser.
Figure 2:
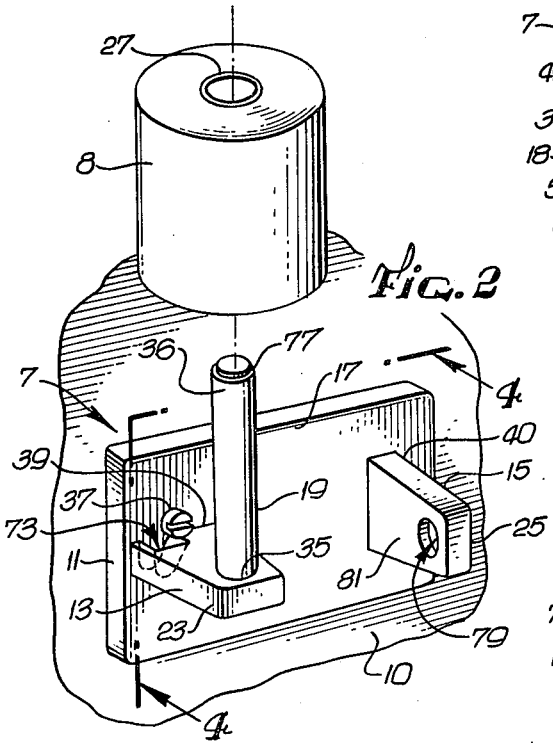
FIG. 2 is a perspective view illustrating the paper roll dispenser including a spindle disposed for roll replacement.

As best illustrated in FIGS. 1 and 3, an optional spring mounted pin 77 projecting from a second end 36 of the spindle 19 can be provided to fit within a shallow indent 79 defined at the inboard face 81 of the second support arm 15. The pin 77 is urged by a spring (not shown) within the spindle 19 such that a spring force causes the pin 77 to occupy the indent 79 to couple the spindle 19 to the second support arm 15 and thereby provide added support for the spindle 19 when the roll dispenser 7 is in its operational configuration as viewed in FIGS. 1 and 4. The spring force which couples the spindle 19 to the second support arm 15 can be overcome in a simple fashion by rotating the first support arm 13 such that the spindle 19 moves clear of the second support arm 15. Alternatively, other support devices, such as a tongue and groove arrangement (not shown) or the like can be substituted for the spring pin 77 and indent 79, if desired.

From the foregoing, it will be appreciated that the present invention provides a new paper roll dispenser 7 which has a decorative appearance and in which an exhausted paper roll 8 can be quickly and easily replaced by a fresh one. When the roll dispenser 7 is in an operative configuration, the stop tab 37 cooperates with the shoulder 73 defined by the proximal end 39 of the first support arm 13 to maintain the spindle 19 in a position wherein it spans the support arms 13 and 15 and rotatably supports a paper roll 8 between them. When, on the other hand, the roll dispenser 7 is configured for roll replacement, the stop tab 37 cooperates with the inboard face 38 defined by the proximal end 39 of the first support arm 13 to maintain the spindle 19 in an elevated position clear of the second support arm 15 whereupon efficient roll replacement can be accomplished. Finally, the inventive paper roll dispenser 7 assures a decorative appearance by permitting the concealment from view of the stop tab 37 and the fasteners 41, 43, 45 and 47 behind the support arms 13 and 15.

While one particular form of the invention has been illustrated and described, it will be apparent that various modifications and improvements thereto can be made without departing from the spirit and scope of the invention. The bracket 11, for example, can comprise more than one piece. Accordingly, it is not intended that the invention be limited by the above description, except as set forth in the appended claims.

I claim:

1. A paper roll dispenser comprising:

bracket means adapted for attachment to a support surface;

first and second support arms extending generally in parallel from said bracket means;

a spindle extending from one end of said first support arm is a direction generally toward said second support arm and having a length sufficient to substantially span the distance between said support arms, said spindle being adapted for rotatably supporting a paper roll between said support arms, said first support arm being rotatably attached to said bracket means such that rotation of said first support arm moves said spindle between a first position spanning between said support arms and a second position swung clear of said second support arm; and a stop tab protruding from said bracket means adjacent to said first support arm, said first support arm having an inboard face which cooperates with said stop tab to limit rotation of said first support arm when said spindle is in said second position.

2. A paper roll support as defined in claim 1, wherein said support arms extend from a front face of said bracket means in a spaced relationship and in a direction generally perpendicular to said front face.

3. A paper roll dispenser as defined in claim 1, wherein said first support arm defines a shoulder which cooperates with said stop tab to limit rotation of said first support arm when said spindle is in said first position spanning between said support arms.

4. A paper roll dispenser as defined in claim 1, wherein said stop tab is substantially concealed from view within a recess defined by said first support arm when said spindle is in said first position spanning between said support arms.

5. A paper roll dispenser as defined in claim 1, wherein said stop tab is a head of a screw used to attach said bracket means to the support surface.

6. A paper roll dispenser as described in claim 1, and further including fastening means for attaching said bracket means to the support surface.

7. A paper roll dispenser as defined in claim 6, wherein said second support arm is rotatable about its arm axis such that said fastening means can be alternately exposed to view or concealed from view behind said second support arm.

8. A paper roll dispenser as defined in claim 6, wherein both said support arms are rotatable about their arm axes such that said fastening means can be alternately exposed to view or concealed from view behind said support arms.

9. A paper roll dispenser comprising:

bracket means adapted for attachment to a support surface;

first and second support arms extending generally in parallel from said bracket means;

a spindle extending from one end of said first support arm in a direction generally toward said second support arm and having a length sufficient to substantially span the distance between said support arms, said spindle being adapted for rotatably supporting a paper roll between said support arms, said first support arm being rotatably attached to said bracket means such that rotation of said first support arm moves said spindle between a first position spanning between said support arms and a second position swung clear of said second support arm;

a stop tab protruding from said bracket means adjacent to said first support arm, said first support arm defines a shoulder which cooperates with said stop tab to limit rotation of said first support arm when said spindle is in said first position, said first support arm further defines a recess wherein said stop tab is substantially concealed when said spindle is in said first position, said support arm having an inboard face which cooperates with said stop tab to limit rotation of said first support arm when said spindle is in said second position.

10. A paper roll dispenser as defined in claim 9, and further comprising:

fastening means projecting through said bracket means adjacent to said support arms for attaching said bracket means to the support surface;

wherein both support arms are rotatable about their arm axes such that said fastening means can be alternately exposed to view or concealed from view behind said support arms.

11. A paper roll dispenser comprising:

bracket means adapted for attachment to a support surface;

first and second support arms extending generally in parallel from said bracket means;

a spindle extending from one end of said first support arm in a direction generally toward said second support arm and having a length sufficient to substantially span the distance between said support arms, said spindle being adapted for rotatably supporting a roll between said support arms, said first support arm being rotatably attached to said bracket means such that rotation of said first support arm moves said spindle between a first position spanning between said support arms and a second position swung clear of said second support arm; and means for stopping said first support arm to limit rotation thereof when said spindle is in said second position.

* * * * *